US006328438B1

(12) United States Patent
Ozawa

(10) Patent No.: US 6,328,438 B1
(45) Date of Patent: Dec. 11, 2001

(54) INK JET RECORDING METHOD AND APPARATUS THEREOF

(75) Inventor: Yoshiyuki Ozawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/328,515

(22) Filed: Jun. 9, 1999

(30) Foreign Application Priority Data

Jun. 11, 1998 (JP) ..... 10-163347

(51) Int. Cl.[7] ..... B41J 2/17
(52) U.S. Cl. ..... 347/96; 347/95
(58) Field of Search ..... 347/96, 41, 37, 347/12, 43, 15

(56) References Cited

U.S. PATENT DOCUMENTS

| | | | | |
|---|---|---|---|---|
| 5,734,403 | | 3/1998 | Suga . | |
| 6,084,619 | * | 7/2000 | Takemoto et al. | 347/96 |
| 6,145,961 | * | 11/2000 | Otsuki | 347/43 |

FOREIGN PATENT DOCUMENTS

| | | | | |
|---|---|---|---|---|
| 0534634 | | 3/1993 | (EP) . | |
| 0679518 | | 11/1995 | (EP) . | |
| 0726155 | | 8/1996 | (EP) . | |
| 0726158 | | 8/1996 | (EP) . | |
| 0726158 A | * | 8/1996 | (EP) | B41J/2/21 |
| 0726159 | | 8/1996 | (EP) . | |
| 0739743 | | 10/1996 | (EP) . | |
| 0802060 | | 10/1997 | (EP) . | |
| 03(1991)-240557 | | 10/1991 | (JP) . | |
| 03(1991)-240558 | | 10/1991 | (JP) . | |

* cited by examiner

*Primary Examiner*—John Barlow
*Assistant Examiner*—M S Shah
(74) *Attorney, Agent, or Firm*—Ladas & Parry

(57) ABSTRACT

A highly efficient ink jet printing method is provided which involves printing of two liquids of an ink composition and a reaction solution containing a reactant capable of functioning to agglomerate ingredients of the ink composition. Efficient printing of two liquids and production of good printed images can be attained by a method wherein ink jet recording heads are reciprocated on a recording medium and an ink composition is deposited on the recording medium both at the time of motion of the recording head in the forward direction and at the time of motion of the recording head in the backward direction, while the reaction solution is deposited onto the recording medium only at the time of motion of the recording head in the forward or backward direction.

9 Claims, 2 Drawing Sheets

INK JET RECORDING METHOD AND APPARATUS THEREOF

BACKGROUND OF THE INVENTION

1. Field of the Invention

The present invention relates to an ink jet recording method and an apparatus therefor. More particularly, the present invention relates to an ink jet recording method wherein a reaction solution and an ink composition are deposited onto a recording medium to perform printing, and an apparatus therefor.

2. Background Art

Ink jet recording is a printing method wherein droplets of an ink composition are ejected and deposited onto recording media, such as paper, to conduct printing. According to this method, images having high resolution and high quality can be printed at a high speed by means of relatively inexpensive apparatuses. In general, the ink composition used in the ink jet recording comprises water as a main component and, added thereto, a colorant and a wetting agent, such as glycerin, for preventing clogging and other purposes.

On the other hand, an ink jet recording method using two liquids of an ink composition and a reaction solution containing an ingredient capable of thickening or agglomerating ingredients of the ink composition has recently been proposed.

For example, regarding the ink jet recording method, the application of a polyvalent metal salt solution onto a recording medium followed by the application of an ink composition containing a dye having at least one carboxyl group has been proposed (for example, Japanese Patent Laid-Open No. 202328/1993). The claimed advantage of this method is that the polyvalent metal ion combines with the dye to form an insoluble complex, the presence of which can offer images having waterfastness and high quality free from color bleeding.

Further, the use of a color ink comprising at least a surfactant for imparting a penetrating property or a solvent having a penetrating property and a salt in combination with a black ink capable of being thickened or agglomerated through the action of the salt has been proposed in the art (Japanese Patent Laid-Open No. 106735/1994). The claimed advantage of this method is that high-quality color images having high image density and free from color bleeding can be yielded. Specifically, an ink jet recording method has been proposed wherein two liquids, a first liquid containing a salt and a second liquid of an ink composition, are printed to realize good images.

Other ink jet recording methods, wherein two liquids are printed, have also been proposed, for example, in Japanese Patent Laid-Open Nos. 240557/1991 and 240558/1991.

In the ink jet recording methods using two liquids, good printing can be realized by bringing a reaction solution into contact with an ink composition. Upon contact of the reaction solution with the ink composition, the reactant contained in the reaction solution is considered to break the state of dispersion of a colorant and other ingredients in the ink composition to agglomerate them, thereby realizing images having high color density and having no significant feathering and unevenness. Further, in color images, uneven color-to-color intermixing in the region of boundary between different colors, that is, color bleeding, can be effectively prevented.

SUMMARY OF THE INVENTION

The present inventors have now found an ink jet recording method, using two liquids, which enables the two liquids to be printed on a recording medium with high efficiency. Accordingly, it is an object of the present invention to provide an ink jet recording method, using two liquids, which enables the two liquids to be printed on a recording medium with high efficiency.

According to an aspect of the present invention, there is provided an ink jet recording method comprising the steps of: ejecting droplets of two liquids of a reaction solution and an ink composition through respective ink jet recording heads; and depositing the droplets of the reaction solution and the droplets of the reaction solution onto a recording medium so that the reaction solution comes into contact with the ink composition on the recording medium, thereby performing printing, the reaction solution containing a reactant capable of functioning to agglomerate ingredients of the ink composition, the ink jet recording heads being reciprocated on the recording medium, the ink composition being deposited onto the recording medium both at the time of motion of the ink jet recording head in the forward direction and at the time of motion of the ink jet recording head in the backward direction, while the reaction solution is deposited onto the recording medium only at the time of motion of the recording head in the forward or backward direction.

According to another aspect of the present invention, there is provided an ink jet recording apparatus for depositing two liquids of a reaction solution and an ink composition onto a recording medium to perform printing, said ink jet recording apparatus comprising:

recording medium carrier means for holding the recording medium and carrying the recording medium in the sub-scanning direction;

reaction solution printing means for ejecting droplets of the reaction solution and depositing the droplets of the reaction solution onto the recording medium;

ink composition printing means for ejecting droplets of the ink composition and depositing the droplets of the ink composition onto the recording medium;

first driving means for reciprocating the reaction solution printing means in the main-scanning direction;

second driving means for reciprocating the ink composition printing means in the main-scanning direction; and control means for controlling each of the means, wherein said control means has a function to deposit the reaction solution from the reaction solution printing means onto the recording medium at the time of motion of the reaction solution printing means in the forward direction and/or in the backward direction while reciprocating the reaction solution printing means in the main-scanning direction by means of the first driving means, a function to deposit the ink composition from the ink composition printing means onto the recording medium at the time of motion of the recording head in the forward direction and/or the backward direction while reciprocating the ink composition printing means in the main-scanning direction by the second driving means, a function to control the position of printing so that the reaction solution comes into contact with the ink composition on the recording medium, and a function to deposit the ink composition onto the recording medium both at the time of motion of the recording head in the forward direction and at the time of motion of the recording head in the backward direction, while the reaction solution is deposited onto the recording medium only at the time of motion of the recording head in the forward or backward direction.

DESCRIPTION OF THE PREFERRED EMBODIMENTS

Figure 1:
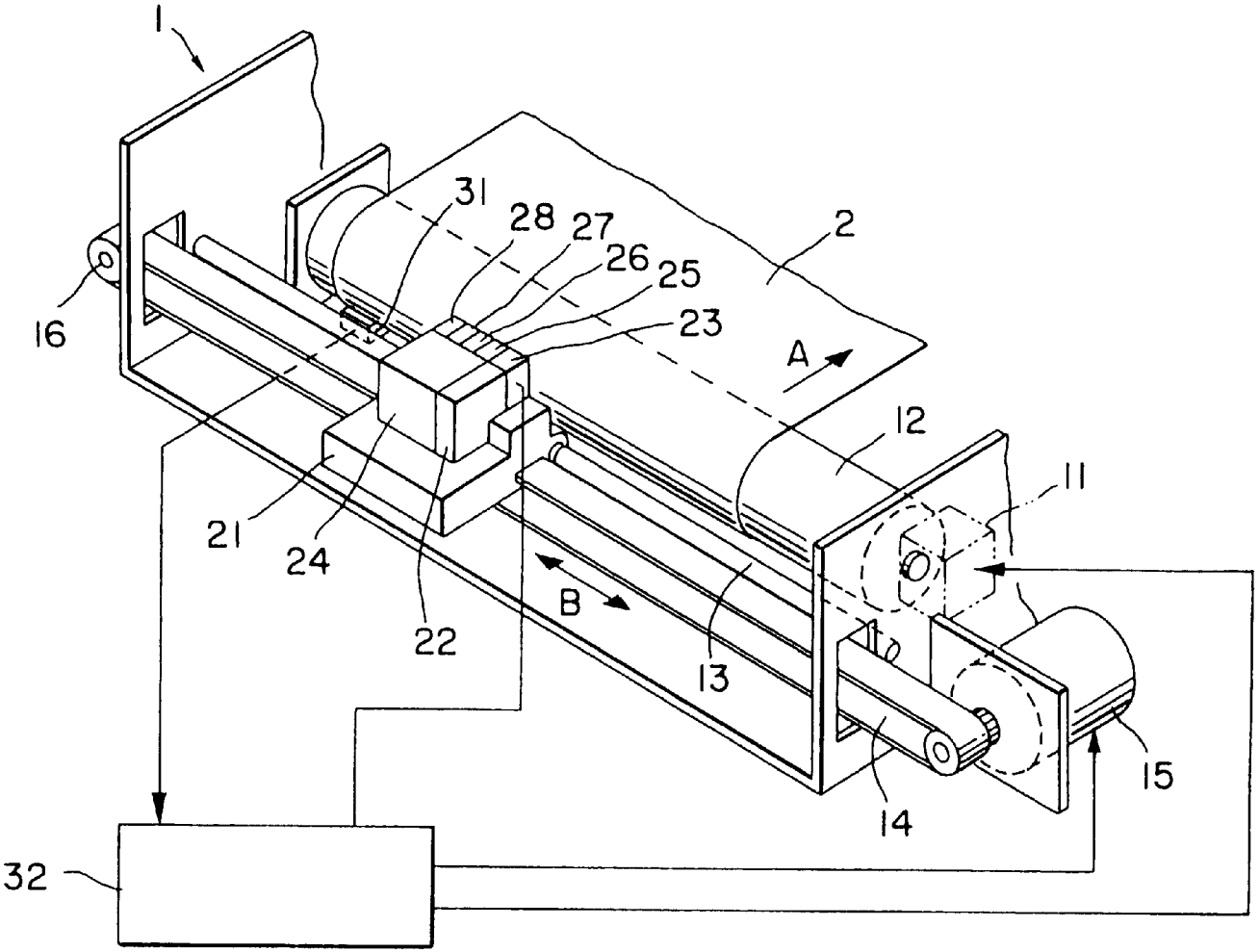
FIG. 1 is a diagram showing an ink jet recording apparatus for practicing the method according to the present invention, wherein a printer 1 comprises: a sheet feed motor 11 and a platen roller 12, linked with the sheet feed motor 11, as recording medium carrying means for holding and carrying a recording medium 2 in a direction indicated by an arrow A in the drawing; a carriage 21 loaded with a recording head 23 for ejecting a reaction solution and recording heads 25, 26, 27, and 28 for ejecting an ink composition; and a control circuit 32 for controlling the sheet feed motor 11, the carriage motor 26, and the recording heads 23, 25, 26, 27, and 28.

According to the ink jet recording method according to the present invention, two liquids, a reaction solution and an ink composition, are ejected as droplets through respective ink jet recording heads and deposited on a recording medium so that the reaction solution and the ink composition come into contact with each other on the recording medium, thereby performing printing. Further, according to the present invention, the ink jet recording heads are reciprocated on the recording medium. In this case, the ink composition is deposited on the recording medium both at the time of motion of the recording head in the forward direction and at the time of motion of the recording head in the backward direction, while the reaction solution is deposited onto the recording medium only at the time of motion of the recording head in the forward or backward direction. In the ink jet recording method using the reaction solution and the ink composition, the reaction solution may be deposited onto the recording medium before the deposition of the ink composition, or after the deposition of the ink composition. Preferably, the reaction solution is deposited onto the recording medium before the deposition of the ink composition. When the reaction solution is deposited onto the recording medium after the deposition of the ink composition, a relatively large amount of the reaction solution should be likely to be used in order to yield an image having quality comparable to an image yielded in the case where the reaction solution is deposited onto the recording medium before the deposition of the ink composition. Increasing the amount of the reaction solution, however, is disadvantageous in that this is likely to create cockle and curling of the recording medium. The recording heads are generally reciprocated on the recording medium. When the recording head for the reaction solution and the recording head for the ink composition are disposed side by side, two recording heads should be provided for the reaction solution in such a manner that the recording heads for the reaction solution sandwich the recording heads for the ink composition therebetween, in order to print the reaction solution before printing the ink composition both at the time of motion of the recording head in the forward direction and at the time of motion of the recording head in the backward direction. Provision of the two recording heads for the reaction solution renders the apparatus complicate.

According to a preferred embodiment of the present invention, the ink composition comprises a pigment and a resin emulsion. When the reactant is a polyvalent metal salt, the ratio of the weight of the reaction solution deposited to the weight of the ink composition deposited is preferably in the range of 1.0:0.2 to 1.1, more preferably in the range of 1.0:0.3 to 0.8. As described below, the ink composition used in the method according to the present invention preferably contains a pigment and a resin emulsion. Preferably, the reaction solution contains a polyvalent metal salt as the reactant. When the ink composition containing a pigment and a resin emulsion is used in combination with the reaction solution containing a polyvalent metal salt as the reactant, a deposition weight ratio in the above range can realize better images.

An apparatus for practicing the ink jet recording method according to the present invention will be explained with reference to the accompanying drawings. FIG. 1 is a schematic view of an ink jet recording apparatus according to a preferred embodiment of the present invention. A printer 1 comprises a sheet feed motor 11 and a platen roller 12, linked with the sheet feed motor 11, as recording medium carrying means for holding and carrying a recording medium 2 in a direction indicated by an arrow A in the drawing, that is, in the sub-scanning direction. The printer 1 further comprises a carriage 21 loaded with a reaction tank 22, a recording head 23 as reaction solution printing means for ejecting the reaction solution, an ink composition tank 24, and recording heads 25, 26, 27, and 28 as ink composition printing means for ejecting the ink composition. The carriage 21 is constructed so that it can be slid on a sliding shaft 13 provided parallel to the shaft of the platen roller 12 and reciprocated in a direction indicated by an arrow B in the drawing, that is, in the main-scanning direction. The recording head 23 and the recording heads 25, 26, 27, and 28 are integral with each other in such a sense that both the recording head 23 and therecording heads 25, 26, 27, and 28 are moved in conjunction with the movement of the carriage 21. The carriage 21 is connected to a carriage belt 14 which is installed on a carriage motor 15 and a pulley 16. Rotation of the motor 15 permits the carriage 21 to be reciprocated. The printer 1 further comprises a sensor 31 for detecting the position of the origin of the carriage 21. The paper feed motor 11, the carriage motor 15, and the recording heads 23, 25, 26, 27, and 28 are coupled to and controlled by a control circuit 32.

Figure 2:
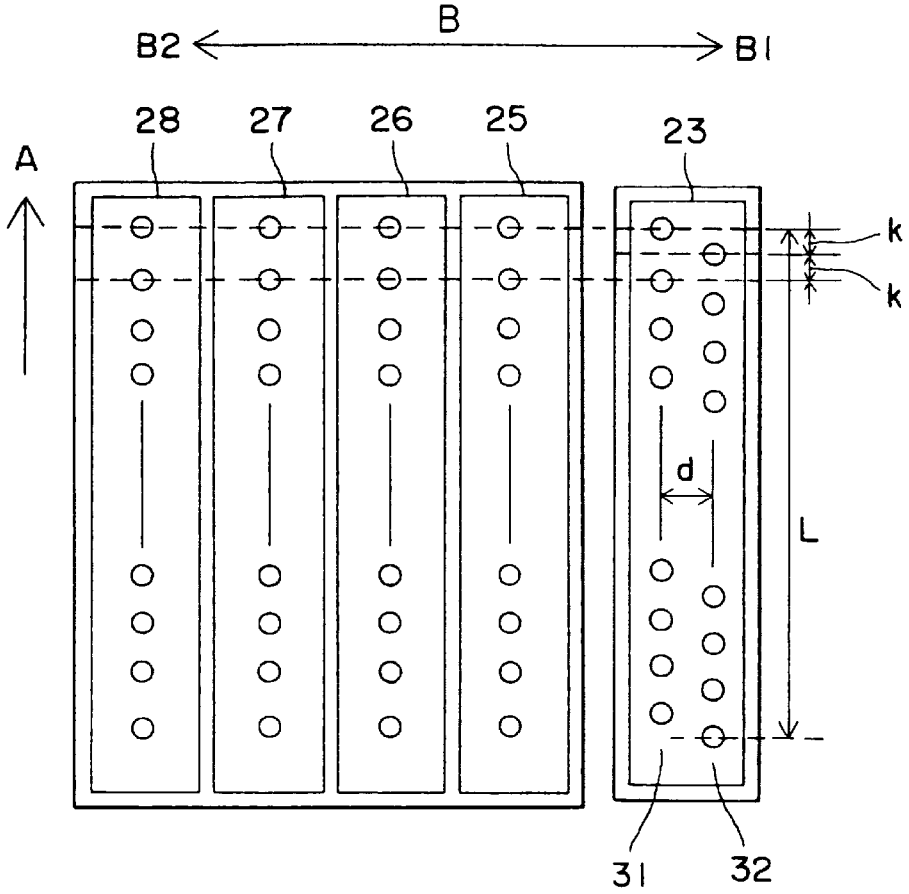
FIG. 2 is an enlarged view of nozzle plates of recording heads 23, 25, 26, 27, and 28, wherein, in the recording head 23, two columns of nozzles, that is, an array of nozzles 31 disposed at equidistant spacings and an array of nozzles 32 disposed at equidistant spacings, are provided while leaving a spacing d between the array of nozzles 31 and the array of nozzles 32 over a length of L, and, as shown in the drawing, the two columns of nozzles are provided in such a manner that the position of the nozzles 32 is shifted from the position of the corresponding nozzles 31 by distance k which is equivalent to half of the nozzle-to-nozzle distance, while a group of nozzles in each of the recording heads 25, 26, 27, and 28 are provided in one column with a nozzle-to-nozzle distance of 2k over a length of L.

FIG. 2 is an enlarged view of nozzle plates for the recording heads 23, 25, 26, 27, and 28. The recording head 23 is reaction solution printing means, and the recording heads 25, 26, 27, and 28 are black ink composition printing means, cyan ink composition printing means, magenta ink composition printing means, and yellow ink composition printing means, respectively.

According to this embodiment, the recording head 23 comprises two columns of nozzles 31 arrayed at equidistant spacings and nozzles 32 arrayed at equidistant spacings while leaving a spacing d between the array of nozzles 31 and the array of nozzles 32 over a length of L. As shown in the drawing, the two columns of nozzles are provided so that the position of the nozzles 32 is shifted from the position of the corresponding nozzles 31 by distance k which is equivalent to half of the nozzle-to-nozzle distance. On the other hand, a group of nozzles in each of the recording heads 25, 26, 27, and 28 are provided in one column with a nozzle-to-nozzle distance of 2k.

According to this embodiment, the recording heads 25, 26, 27, and 28 eject the ink composition upon scanning of the recording heads in both directions B1 and B2 in the drawing, that is, both at the time of motion of the recording heads in the forward direction and at the time of motion of the recording heads in the backward direction to perform printing on the recording medium. On the other hand, the recording head 23 prints the reaction solution only when the recording head 23 is scanned in direction B1 in the drawing.

When the carriage 21 is scanned in direction B1 in FIG. 2, the reaction solution is ejected through the recording head 23, and the ink composition is ejected through the recording heads 25, 26, 27, and 28, whereby printing is performed on a recording medium. In this case, the reaction solution is printed on the recording medium before printing of the ink composition. The reaction solution from the group of nozzles 31 is deposited at a position where the ink composition from the recording heads 25, 26, 27, and 28 is to be deposited. The reaction solution and the ink composition are reacted with each other at this position. On the other hand, the reaction solution from the group of nozzles 32 is deposited at a position intermediate between dots formed by deposition of the ink composition from the recording heads 25, 26, 27, and 28. Therefore, the ink composition reactive with the reaction solution is absent at this intermediate position.

As soon as the recording heads have reached one end of the sliding shaft 13 as a result of scanning toward the direction B1, the recording medium is carried in the direction A in the drawing by length k by means of the sheet feed motor 11 and the platen roller 12 linked with the sheet feed motor 11. In this case, k is equal to 1/(2n) in. wherein n is the number of nozzles per in., that is, nozzle density (dpi), in the recording head. Thereafter, the carriage 21 is scanned in the direction B2 in FIG. 2. At that time, the reaction solution is not ejected through the recording head 23. On the other hand, the ink composition is ejected through the recording heads 25, 26, 27, and 28 and printed on the recording medium. In this case, the ink composition is deposited at a position intermediate between dots in the array of dots printed at the time of scanning in the direction B1. The reaction solution has already been deposited at this position. Therefore, the reaction solution is reacted with the ink composition at this position.

Figure 3:
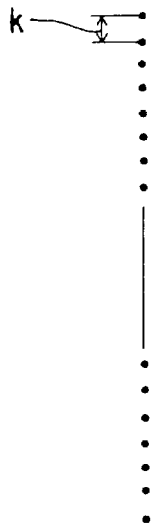
FIG. 3 is a diagram showing an array of dots printed by the recording heads shown in FIG. 2.

The printing procedure as described above results in printing of an array of dots with a dot-to-dot distance of k shown in FIG. 3. This image corresponds to a resolution of 2n dpi when the nozzle density is n dpi.

Subsequently, the recording medium is carried by length L in the drawing, followed by repetition of printing by means of the recording heads 23, 25, 26, 27, and 28 to form an image.

Reaction solution

The reaction solution used in the present invention contains a reactant that can break the state of dispersion of the colorant and the like in the ink composition to agglomerate the colorant component and the like.

Examples of reactants usable herein include polyvalent metal salts, polyamines, polyamine derivatives, acidic liquids, and cationic surfactants.

When the reactant is a polyvalent metal salt, a preferred example thereof is a salt that is constituted by divalent or higher polyvalent metallic ions and anions bonded to the polyvalent metallic ions and is soluble in water. Specific examples of polyvalent metallic ions include divalent metallic ions, such as $ca^{2+}$, $Cu^{2+}$, $Ni^{2+}$, $Mg^{2+}$, $Zn^{2+}$, and $Ba^{2+}$, trivalent metallic ions, such as $Al^{3+}$, $Fe^{3+}$, and $Cr^{3+}$. Anions include $Cl^-$, $No_3^-$, $I^-$, $Br^-$, $Clo_3^-$, and $CH_3COO^-$.

Especially, a metal salt constituted by $Ca^{2+}$ or $Mg^{2+}$ provides favorable results in terms of pH of the reaction solution and the quality of prints.

The concentration of the polyvalent metal salt in the reaction solution may be suitably determined so as to attain the effect of providing good print quality and preventing clogging. It, however, is preferably about 0.1 to 40% by weight, more preferably about 5 to 25% by weight.

According to a preferred embodiment of the present invention, the polyvalent metal salt contained in the reaction solution is constituted by divalent or higher polyvalent metallic ions and nitrate ions or carboxylate ions bonded to the polyvalent metallic ions and is soluble in water.

In this case, preferably, the carboxylate ions are derived from a saturated aliphatic monocarboxylic acid having 1 to 6 carbon atoms and a carbocyclic monocarboxylic acid having 7 to 11 carbon atoms. Preferred examples of the saturated aliphatic monocarboxylic acid having 1 to 6 carbon atoms include formic acid, acetic acid, propionic acid, butyric acid, isobutyric acid, valeric acid, isovaleric acid, pivalic acid, and hexanoic acid. Among them, formic acid and acetic acid are particularly preferred.

A hydrogen atom(s) on the saturated aliphatic hydrocarbon residue in the monocarboxylic acid may be substituted by a hydroxyl group. Preferred examples of such carboxylic acids include lactic acid. Preferred examples of the carbocyclic monocarboxylic acid having 6 to 10 carbon atoms include benzoic acid and naphthoic acid with benzoic acid being more preferred.

Preferred polyallylamine and polyallylamine derivative usable as the reactant are cationic polymers which are soluble in water and can be positively charged in water. Such polymers include, for example, those represented by the following formulae (I), (II), and (III):

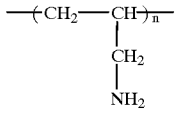

(I)

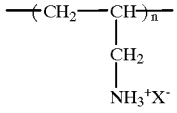

(II)

-continued (III)

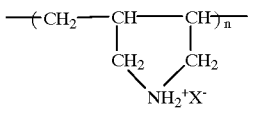

wherein $X^-$ represents chloride, bromide, iodide, nitrate, phosphate, sulfate, acetate or other ion.

In addition, a copolymer of an allylamine with a diallylamine and a copolymer of diallylmethylammmonium chloride with sulfur dioxide may also be used.

The content of the polyallylamine and the polyallylamine derivative is preferably 0.5 to 10% by weight based on the reaction solution.

According to a preferred embodiment of the present invention, the reaction solution contains a wetting agent comprising a high-boiling organic solvent. The high-boiling organic solvent functions to prevent the reaction solution from drying out, thereby preventing clogging of the head. Preferred examples of high-boiling organic solvents usable herein, some of which are described above in connection with the polyol, include: polyhydric alcohols such as ethylene glycol, diethylene glycol, triethylene glycol, polyethylene glycol, polypropylene glycol, propylene glycol, butylene glycol, 1,2,6-hexanetriol, thioglycol, hexylene glycol, glycerin, trimethylolethane, and trimethylolpropane; alkyl ethers of polyhydric alcohols, such as ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, and triethylene glycol monobutyl ether; urea, 2-pyrrolidone, N-methyl-2-pyrrolidone, 1,3-dimethyl-2-imidazolidinone, and triethanolamine.

Although the amount of the high-boiling organic solvent added is not particularly limited, it is preferably about 0.5 to 40% by weight, more preferably about 2 to 20% by weight.

According to a preferred embodiment of the present invention, the reaction solution may further comprise a low-boiling organic solvent. Examples of preferred low-boiling organic solvents usable herein include methanol, ethanol, n-propyl alcohol, iso-propyl alcohol, n-butanol, sec-butanol, tert-butanol, iso-butanol, and n-pentanol. Monohydric alcohols are particularly preferred. The low-boiling organic solvent has the effect of shortening the time taken for drying the ink composition. The amount of the low-boiling organic solvent added is preferably 0.5 to 10% by weight, more preferably 1.5 to 6% by weight.

According to a preferred embodiment of the present invention, the reaction solution may further comprise a penetrant. Penetrants usable herein include various surfactants such as anionic, cationic, and amphoteric surfactants; alcohols such as methanol, ethanol, and iso-propyl alcohol; and lower alkyl ethers of polyhydric alcohols, such as ethylene glycol monomethyl ether, diethylene glycol monoethyl ether, diethylene glycol monobutyl ether, triethylene glycol monobutyl ether, propylene glycol monobutyl ether, and dipropylene glycol monobutyl ether.

A color colorant described below in the column of "Ink composition" may be added to the reaction solution so that the reaction solution can serve also as an ink composition.

Ink composition

According to the present invention, in the case of monochrome printing, the ink composition refers to a black ink composition, while in the case of color printing, the ink composition refers to color ink compositions, specifically a yellow ink composition, a magenta ink composition, a cyan ink composition, and optionally a black ink composition.

The ink composition used in the present invention comprises at least a colorant and water.

The colorant contained in the ink composition used in the present invention may be either a dye or a pigment. When the penetration of the colorant component contained in the ink is inhibited by insolubilization, thickening or other action of the ink composition, the pigment dispersed in an aqueous medium is more advantageous than the dye dissolved in the aqueous medium.

Dyes usable herein include various dyes commonly used in ink jet recording, such as direct dyes, acid dyes, foodstuff dyes, basic dyes, reactive dyes, disperse dyes, vat dyes, soluble vat dyes, and reactive disperse dyes.

Regarding the pigment, inorganic and organic pigments are usable without any particular limitation. Examples of inorganic pigments usable herein include, in addition to titanium oxide and iron oxide, carbon blacks produced by known processes, such as contact, furnace, and thermal processes. Examples of organic pigments usable herein include azo pigments (including azo lake, insoluble azo pigment, condensed azo pigment, and chelate azo pigment), polycyclic pigments (for example, phthalocyanine, perylene, perinone, anthraquinone, quinacridone, dioxazine, thioindigo, isoindolinone, and quinophthalone pigments), dye chelates (for example, basic dye chelates and acid dye chelates), nitro pigments, nitroso pigments, and aniline black.

According to a preferred embodiment of the present invention, the above pigment is preferably added, to the ink, in the form of a pigment dispersion prepared by dispersing the pigment in an aqueous medium with the aid of a dispersant or a surfactant. Preferred dispersants usable herein include those commonly used in the preparation of a dispersion of a pigment, for example, polymeric dispersant.

Preferred examples of dispersant or surfactants usable herein include polyacrylic acid, polymethacrylic acid, acrylic acid/acrylonitrile copolymer, vinyl acetate/acrylic ester copolymer, acrylic acid/alkyl acrylate copolymer, styrene/acrylic acid copolymer, styrene/methacrylic acid copolymer, styrene/acrylic acid/alkyl acrylate copolymer, styrene/methacrylic acid/alkyl acrylate copolymer, styrene/α-methylstyrene/acrylic acid copolymer, styrene/α-methylstyrene/acrylic acid/alkyl acrylate copolymer, styrene/maleic acid copolymer, vinylnaphthalene/maleic acid copolymer, vinyl acetate/ethylene copolymer, vinyl acetate/fatty acid/vinylethylene copolymer, vinyl acetate/maleic ester copolymer, vinyl acetate/crotonic acid copolymer, and vinyl acetate/acrylic acid copolymer.

According to a preferred embodiment of the present invention, the weight average molecular weight of the copolymer is preferably about 3,000 to 50,000, more preferably about 5,000 to 30,000, most preferably about 7,000 to 15,000.

The dispersant may be added in any amount so far as the pigment can be stably dispersed and the other effects of the present invention are not lost. According to a preferred embodiment of the present invention, the amount of the dispersant used is preferably in the range of from about 1:0.06 to 1:3, more preferably in the range of from about 1:0.125 to 1:3, in terms of the ratio of the pigment to the dispersant.

In this connection, it will be apparent to a person having ordinary skill in the art that the dispersant and the surfactant contained in the dispersion of the pigment function also as the dispersant and the surfactant for the ink composition.

The amount of the pigment added to the ink is preferably about 0.5 to 25% by weight, more preferably about 2 to 15% by weight.

The ink composition used in the present invention may further contain a dispersant or a surfactant. Examples of dispersants or surfactants usable herein include various surfactants described above in connection with the resin emulsion.

According to a preferred embodiment of the present invention, the ink composition of the present invention contains a resin emulsion. The term "resin emulsion" used herein refers to an emulsion comprising water as a continuous phase and the following resin component as a dispersed phase. Resin components as the dispersed phase include acrylic resin, vinyl acetate resin, styrene/butadiene resin, vinyl chloride resin, acryl/styrene resin, butadiene resin, styrene resin, crosslinked acrylic resin, crosslinked styrene resin, benzoguanamine resin, phenolic resin, silicone resin, and epoxy resin.

According to a preferred embodiment of the present invention, the resin is a polymer having a combination of a ydrophilic segment with a hydrophobic segment. The particle iameter of the resin component is not particularly limited so far as the resin component can form an emulsion. It, however, is preferably not more than about 150 nm, more preferably about 5 to 100 nm.

The resin emulsion may be prepared by dispersion polymerization of a resin monomer, optionally together with a surfactant, in water. For example, an emulsion of an acrylic resin or a styrene/acryl resin may be prepared by subjecting an ester of (meth)acrylic acid or alternatively an ester of (meth)acrylic acid in combination with styrene to dispersion polymerization in water in the presence of a surfactant. In general, the mixing ratio of the resin component to the surfactant is preferably about 10:1 to 5:1. When the amount of the surfactant used is in the above range, better waterfastness and penetration of the ink can be attained. The surfactant used herein is not particularly limited. Examples of preferred surfactants usable herein include anionic surfactants (for example, sodium dodecylbenzenesulfonate, sodium laurylate, and an ammonium salt of polyoxyethylene alkyl ether sulfates), nonionic surfactants (for example, polyoxyethylene alkyl ethers, polyoxyethylene alkyl esters, polyoxyethylene sorbitan fatty acid esters, polyoxyethylene alkylphenyl ethers, polyoxyethylenealkylamines, and polyoxyethylenealkylamides). They may be used alone or in combination of two or more. Further, acetylene glycol (OLFINE Y and Surfynol 82, 104, 440, 465, and 485 (all the above products being manufactured by Air Products and Chemicals Inc.) may also be used.

The ratio of the resin as the component constituting the dispersed phase to water is suitably 60 to 400 parts by weight based on 100 parts by weight of the resin with 100 to 200 parts by weight, based on 100 parts by weight of the resin, of water being preferred.

Known resin emulsions may also be used as the above resin emulsion. For example, resin emulsions described in Japanese Patent Publication No. 1426/1987 and Japanese Patent Laid-Open Nos. 56573/1991, 79678/1991, 160068/1991, and 18462/1992 as such may be used as the resin emulsion in the present invention.

Further, commercially available resin emulsions may also be used, and examples thereof include Microgel E-1002 and E-5002 (emulsion of styrene/acryl resin, manufactured by Nippon Paint Co., Ltd.), Voncoat 4001 (emulsion of acrylic resin, manufactured by Dainippon Ink and Chemicals, Inc.), Voncoat 5454 (emulsion of styrene/acryl resin, manufactured by Dainippon Ink and Chemicals, Inc.), SAE-1014 (emulsion of styrene/acryl resin, manufactured by Nippon Zeon Co., Ltd.), and Saivinol SK-200 (emulsion of acrylic resin, manufactured by Saiden Chemical Industry Co., Ltd).

According to the present invention, in the ink composition, the amount of the resin emulsion incorporated therein is preferably such that the amount of the resin component is in the range of from 0.1 to 40% by weight, more preferably in the range of from 1 to 25% by weight, based on the ink composition.

The resin emulsion, by virtue of interaction with the polyvalent metal ion, has the effect of inhibiting the penetration of a coloring component and, further, accelerating the fixation of the colorant component on the recording medium. Further, some resin emulsions have such an additional effect that they form a film on the recording medium to improve the rubbing/scratch resistance of the prints.

According to a preferred embodiment of the present invention, the ink composition contains an alginic acid derivative. Examples of preferred alginic acid derivatives include alkali metal salts (for example, sodium and potassium salts) of alginic acid, organic salts (for example, triethanolamine salt) of alginic acid, and ammonium alginate.

The amount of the alginic acid derivative added to the ink composition is preferably about 0.01 to 1% by weight, more preferably about 0.05 to 0.5% by weight.

Although the reason why the addition of the alginic acid derivative results in the formation of good images has not been fully elucidated yet, it is believed that the reactant present in the reaction solution, particularly the polyvalent metal salt, is reacted with the alginic acid derivative contained in the ink composition to change the state of dispersion of the colorant. this accelerates the fixation of the colorant onto the recording medium.

The ink composition used in the present invention may contain an inorganic oxide colloid. Preferred examples of inorganic oxide colloids usable herein include colloidal silica and alumina colloid. These are generally a colloidal solution of ultrafine particles of $SiO_2$, $Al_2O_3$ or the like dispersed in water or an organic solvent. Commercially available inorganic oxide colloids are generally such that the dispersion medium is water, methanol, 2-propanol, n-propanol, xylene or the like and the diameter of $SiO_2$, $Al_2O_3$ and other particles is 5 to 100 nm. Further, pH of the colloidal solutions of inorganic oxide is, in many cases, adjusted to the acidic or alkaline side rather than the neutral region. This is because the stable dispersion region of the inorganic oxide colloid is present on the acidic side or the alkaline side. In adding the colloidal solution to the ink composition, pH of the stable dispersion region of the inorganic oxide colloid and pH of the ink should be taken into consideration.

The amount of the inorganic oxide colloid added to the ink composition is preferably 0.1 to 15% by weight, and addition of two or more inorganic oxide colloids is also possible.

According to a preferred embodiment of the present invention, the ink composition contains an organic solvent. The organic solvent is preferably a low-boiling organic solvent, and preferred examples thereof include methanol, ethanol, n-propyl alcohol, iso-propyl alcohol, n-butanol, sec-butanol, tert-butanol, iso-butanol, and n-pentanol. Monohydric alcohols are particularly preferred. The low-boiling organic solvent has the effect of shortening the time taken for drying the ink composition.

According to a preferred embodiment of the present invention, the ink composition of the present invention further contains a high-boiling organic solvent as a wetting agent. Preferred examples of high-boiling organic solvents usable herein include polyhydric alcohols such as ethylene glycol, diethylene glycol, triethylene glycol, polyethylene glycol, polypropylene glycol, propylene glycol, butylene glycol, 1,2,6-hexanetriol, thioglycol, hexylene glycol, glycerin, trimethylolethane, and trimethylolpropane; alkyl ethers of polyhydric alcohols, such as ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, and triethylene glycol monobutyl ether; urea; 2-pyrrolidone; N-methyl-2-pyrrolidone; and 1,3-dimethyl-2-imidazolidinone; and triethanolamine.

The amount of the wetting agent added is preferably 0.5 to 40% by weight, more preferably 2 to 20% by weight, based on the ink composition. The amount of the low-boiling organic solvent added is preferably 0.5 to 10% by weight, more preferably 1.5 to 6% by weight, based on the ink composition.

According to a preferred embodiment of the present invention, the ink composition contains a saccharide. Specific examples of saccharides usable herein include monosaccharide, disaccharides, oligosaccharides (including trisaccharides and tetrasaccharides), and other polysaccharides, preferably glucose, mannose, fructose, ribose, xylose, arabinose, galactose, aldonic acid, glucitol, sorbitol, maltose, cellobiose, lactose, sucrose,trehalose, andmaltotriose. Theterml "polysaccharides" used herein means saccharides in the broad sense as including substances which exist widely in the world of nature, such as alginic acid, α-cyclodextrin, and cellulose.

Derivatives of these saccharides usable herein include reducing sugars of the above saccharides (for example, sugar alcohols represented by the general formula $HOCH_2(CHOH)_nCH_2OH$, wherein n is an integer of 2 to 5), oxidizing sugars (for example, aldonic acid or uronic acid), amino acids, and thiosugars. Among them, sugar alcohols are particularly preferred, and specific examples thereof include maltitol and sorbitol.

The content of the saccharide is suitably 0.1 to 40% by weight, preferably 0.5 to 30% by weight, based on the ink composition.

If necessary, pH adjustors, preservatives, antimolds and the like may also be added to the ink composition of the present invention.

EXAMPLE

The present invention will be described in more detail with reference to the following examples, though it is not limited to these examples only.

Preparation of reaction solution and ink compositions

| Ink composition | |
|---|---|
| Carbon Black MA7 (manufactured by Mitsubishi Kasei Corp.) | 5 wt % |
| Styrene/acrylic acid copolymer (dispersant) | 1 wt % |
| Voncoat 4001 (acrylic resin emulsion, resin component content 50%, minimum film-forming temp. 5° C., manufactured by Dainippon Ink and Chemicals, Inc.) | 3 wt % |
| Sucrose | 0.7 wt % |

-continued

| Ink composition | |
|---|---|
| Maltitol | 6.3 wt % |
| Glycerin | 10 wt % |
| 2-Pyrrolidone | 2 wt % |
| Ethanol | 4 wt % |
| Pure water | Balance |

Carbon black and the dispersant were mixed together, and the mixture, together with glass beads (diameter: 1.7 mm, amount: 1.5 times (by weight) larger than the mixture), was dispersed for 2 hr in a sand mill (manufactured by Yasukawa Seisakusho). Thereafter, the glass beads were removed, the other additives were added, and the mixture was stirred at room temperature for 20 min. The mixture was filtered through a 5-μm membrane filter to prepare an ink composition.

| Reaction solution | |
|---|---|
| Magnesium sulfate hexahydrate | 25 wt % |
| Triethylene glycol monobutyl ether | 10 wt % |
| Glycerin | 20 wt % |
| Pure water | Balance |

Evaluation test on printing

The ink composition and the reaction solution were used to print blotted images (100% duty) and characters as printed images by means of a printer having a nozzle structure shown in FIG. 2. In this case, Xerox 4024 (manufactured by Xerox) was used as recording paper.

The resolution was 360 dpi, and the weight of the ink per dot was 50 ng. When the reaction solution was printed before printing of the ink composition, the weight of the reaction solution printed was varied in the range of 5 ng to 60 ng.

The quality of the prints thus obtained was evaluated in terms of dropouts, sheet cockle, feathering, and uneven printing according to the following criteria.

Dropouts

A: Droplets were not found at all by observation under microscope.

B: Dropouts were found by observation under microscope, although they were not found by visual inspection.

C: Dropouts were found by visual inspection.

Sheet cockle

A: Sheet waviness was not found at all.

B: Sheet waviness of not more than 10 mm was found.

C: Sheet waviness exceeding 10 mm was found.

Feathering

A: Feathering was not found at all by observation under microscope.

B: Feathering was found by observation under microscope, although it was not found by visual inspection.

C: Feathering was found by visual inspection.

Uneven printing

A: Images could be evenly dried, and also after drying, unevenness of printing was not found in images.

B: Although images were unevenly dried, unevenness of printing was not found in images after drying.

C: Images were unevenly dried, and also after drying, unevenness of printing was found in images.

The results were as summarized in the following table.

| Weight of reaction solution, ng | Weight ratio of reaction solution to ink | Drop-outs | Paper cockling | Feather-ing | Uneven printing |
|---|---|---|---|---|---|
| 5 | 0.1 | C | A | B | C |
| 10 | 0.2 | B | A | B | B |
| 15 | 0.3 | A | A | A | A |
| 20 | 0.4 | A | A | A | A |
| 25 | 0.5 | A | A | A | A |
| 30 | 0.6 | A | A | A | A |
| 35 | 0.7 | A | A | A | A |
| 40 | 0.8 | A | A | A | A |
| 45 | 0.9 | A | B | A | A |
| 50 | 1.0 | A | B | A | A |
| 55 | 1.1 | A | B | B | A |
| 60 | 1.2 | A | C | B | A |

What is claimed is:

1. An ink jet recording method comprising the steps of: ejecting droplets of two liquids of a reaction solution and an ink composition through respective ink jet recording heads; and depositing the droplets of the ink composition and the droplets of the reaction solution onto a recording medium so that the reaction solution comes into contact with the ink composition on the recording medium, thereby performing printing, the reaction solution containing a reactant capable of functioning to agglomerate ingredients of the ink composition, the ink jet recording heads being reciprocated on the recording medium, the ink composition being deposited onto the recording medium both at the time of motion of the ink jet recording head in the forward direction and at the time of motion of the ink jet recording head in the backward direction, while the reaction solution is deposited onto the recording medium only at the time of motion of the ink jet recording head in the forward or backward direction, wherein the density of nozzles in the recording head is n dpi and the recording medium is carried by 1/(2n) inch in the sub-scanning direction in a period between printing at the time of motion of the recording head in the forward direction and printing at the time of motion of the recording head in the backward direction, whereby an image is printed with a resolution of 2n dpi.

2. The ink jet recording method according to claim 1, wherein the ink composition contains a pigment and a resin emulsion and, when the reactant is a polyvalent metal salt, the ratio of the weight of the reaction solution deposited to the weight of the ink composition deposited being brought to 1.0 0.2 to 1.1.

3. The ink jet recording method according to claim 1, wherein the reaction solution comprises a polyvalent metal salt and/or a polyallylamine as the reactant, and the ink composition comprises at least a colorant, a resin emulsion, and an aqueous solvent.

4. The ink jet recording method according to claim 3, wherein the colorant is a pigment.

5. An ink jet recording apparatus for depositing two liquids of a reaction solution and an ink composition onto a recording medium to perform printing, said ink jet recording apparatus comprising:

recording medium carrier means for holding the recording medium and carrying the recording medium in the sub-scanning direction;

reaction solution printing means for ejecting droplets of the reaction solution and depositing the droplets of the reaction solution onto the recording medium;

ink composition printing means for ejecting droplets of the ink composition and depositing the droplets of the ink composition onto the recording medium;

first driving means for reciprocating the reaction solution printing means in the main-scanning direction;

second driving means for reciprocating the ink composition printing means in the main- scanning direction; and control means for controlling each of the means, wherein said control means has a function to deposit the reaction solution from the reaction solution printing means onto the recording medium at the time of motion of the reaction solution printing means in the forward direction and/or in the backward direction while reciprocating the reaction solution printing means in the main-scanning direction by means of the first driving means, a function to deposit the ink composition from the ink composition printing means onto the recording medium at the time of motion of the recording head in the forward direction and/or the backward direction while reciprocating the ink composition printing means in the main-scanning direction by the second driving means, a function to control the position of printing so that the reaction solution comes into contact with the ink composition on the recording medium, and a finction to deposit the ink composition onto the recording medium both at the time of motion of the recording head in the forward direction and at the time of motion of the recording head in the backward direction, while the reaction solution is deposited onto the recording medium only at the time of motion of the recording head in the forward or backward direction, wherein the density of nozzles in the recording head is n dpi and the recording medium is carried by 1/(2n) inch in the sub-scanning direction in a period between printing at the time of motion of the recording head in the forward direction and printing at the time of motion of the recording head in the backward direction, whereby an image is printed with a resolution of 2n dpi.

6. The ink jet recording apparatus according to claim 5, wherein the reaction solution printing means is integral with the ink composition printing means.

7. The ink jet recording apparatus according to claim 6, wherein the reaction solution printing means and the ink composition printing means are ink jet recording heads having a group of nozzles.

8. The ink jet recording method according to claim 2, wherein the reaction solution comprises a polyvalent metal salt or a polyallylamine or both as the reactant, and the ink composition comprises at least a colorant, a resin emulsion, and an aqueous solvent.

9. The ink jet recording method according to claim 8, wherein the colorant is a pigment.

* * * * *

UNITED STATES PATENT AND TRADEMARK OFFICE

CERTIFICATE OF CORRECTION

PATENT NO. : 6,328,438 B1
DATED : December 11, 2001
INVENTOR(S) : Yoshiyuki Ozawa It is certified that error appears in the above-identified patent and that said Letters Patent is hereby corrected as shown below:

Title page,
Item [54], delete “thereof” and insert -- therefor --.

Signed and Sealed this

Eighth Day of April, 2003

JAMES E. ROGAN
*Director of the United States Patent and Trademark Office*